United States Patent [19]

Edmundson et al.

[11] 4,431,132

[45] Feb. 14, 1984

[54] CONTROL VALVE SYSTEMS FOR GAS WATER HEATERS

[75] Inventors: Michael J. Edmundson, Nelson; Christopher Halstead, Accrington; Leslie Hammond, Burnley, all of England

[73] Assignee: Thorn Gas Appliances Limited, London, England

[21] Appl. No.: 272,642

[22] Filed: Jun. 11, 1981

[30] Foreign Application Priority Data

Jun. 13, 1980 [GB] United Kingdom ..... 8019406

[51] Int. Cl.[3] ..... F22B 35/00; F28F 27/00

[52] U.S. Cl. ..... 236/25 A; 122/447; 122/448 S; 126/350 R; 126/351

[58] Field of Search ..... 126/350 R, 351; 122/447, 448 S; 236/24.5, 25 A, 25 R; 73/861.63

[56] References Cited

U.S. PATENT DOCUMENTS 2,023,568 12/1935 Albersheim et al. ..... 73/861.63
2,258,590 10/1941 Merten ..... 126/350 R
3,722,523 3/1973 Kawabata et al. ..... 126/351

FOREIGN PATENT DOCUMENTS 529570 11/1940 United Kingdom ..... 236/25

*Primary Examiner*—Edward G. Favors
*Assistant Examiner*—Steven E. Warner
*Attorney, Agent, or Firm*—Fleit, Jacobson, Cohn & Price

[57] ABSTRACT

A control valve system for a gas-fired, instantaneous water heater is disclosed. The valve has a "snap" action constructed to inhibit the supply to the burner of insufficient amounts of gas to ensure reliable ignition. In one example, a flexible diaphragm has opposite sides connected via respective passages to receive pressures upstream and downstream of a restriction in a water flow path. The diaphragm opens a gas valve in response to a predetermined flow of water along the path. In order to provide the "snap" action, a further passage is provided that links the two passages coupled to the diaphragm and contains a ball that can block the further passage only when the water flow is sufficient to open the gas valve sufficiently for an ignitable quantity of gas to flow to the burner.

3 Claims, 3 Drawing Figures

CONTROL VALVE SYSTEMS FOR GAS WATER HEATERS

Figure 1:
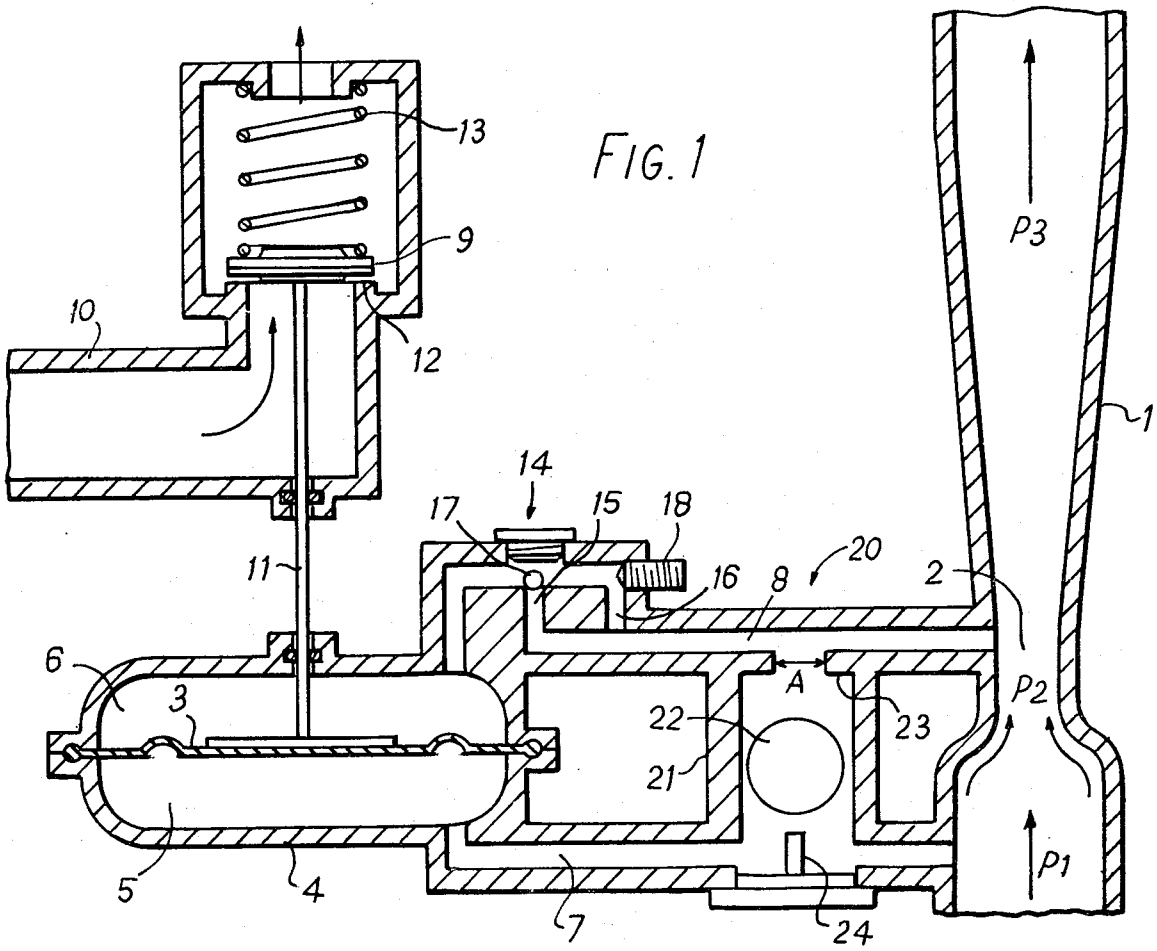

The present invention relates to control valve systems for gas-fired instantaneous water heaters.

A gas fired instantaneous water heater includes a control valve system which is responsive to flow of water at a preset rate to allow gas to flow to a burner.

A known example of such a system comprises a valve in the gas supply line to the main burner of a heater. The valve in the gas supply line is connected by a rod to a flexible diaphragm having one face exposed to the pressure upstream of a restriction in the water supply line, and the other face exposed to the pressure downstream of the restriction. Movement of the diaphragm is opposed by a spring. The gas valve opens when the pressure difference across the diaphragm is sufficient to overcome the forces of the spring.

According to one aspect of the invention, there is provided a control valve system for a gas-fired, instantaneous water heater, including a pressure sensor responsive to the rate at which water is conveyed by a ducting means to a heat exchanger incorporating a gas burner, a control valve, operated by said pressure sensor, for controlling the supply of gas to the burner, a connecting system coupling said pressure sensor to the ducting means and a control arrangement to inhibit said pressure sensor from responding to the water flow until the flow exceeds a rate sufficient to cause the pressure sensor to open said control valve to an extent sufficient to permit a reliable flow of ignitable amounts of gas to said burner.

According to a further aspect of the invention, there is provided a control valve system for a gas-fired instantaneous water heater, comprising a water duct including a restriction to produce different pressures upstream and downstream of the restriction in response to flow of water through the duct, gas control means coupled by first and second passages to the duct upstream and downstream of the restriction to control the flow of gas in response to the difference between the said pressures, and further means for controlling the difference between the pressures in the first and second passages.

According to a yet further aspect of the invention, there is provided a control valve system for a gas-fired instantaneous water heater, comprising:

a valve for controlling the flow of gas, a duct including a restriction to produce different pressures upstream and downstream of the restriction in response to flow of water through the duct, valve opening means coupled to the duct upstream and downstream of the restriction to respond to the different pressures to open the said valve, first and second passages coupling the valve opening means to the duct upstream and downstream of the restriction and means for maintaining the difference between the pressures in the first and second passages less than a first predetermined level at or below which the valve is shut until the rate of flow of water through the duct is sufficient to produce a difference between said pressures upstream and downstream of the restriction greater than a second predetermined level sufficient to open the said valve sufficiently to permit a reliable flow of ignitable amounts of gas.

Figure 2:
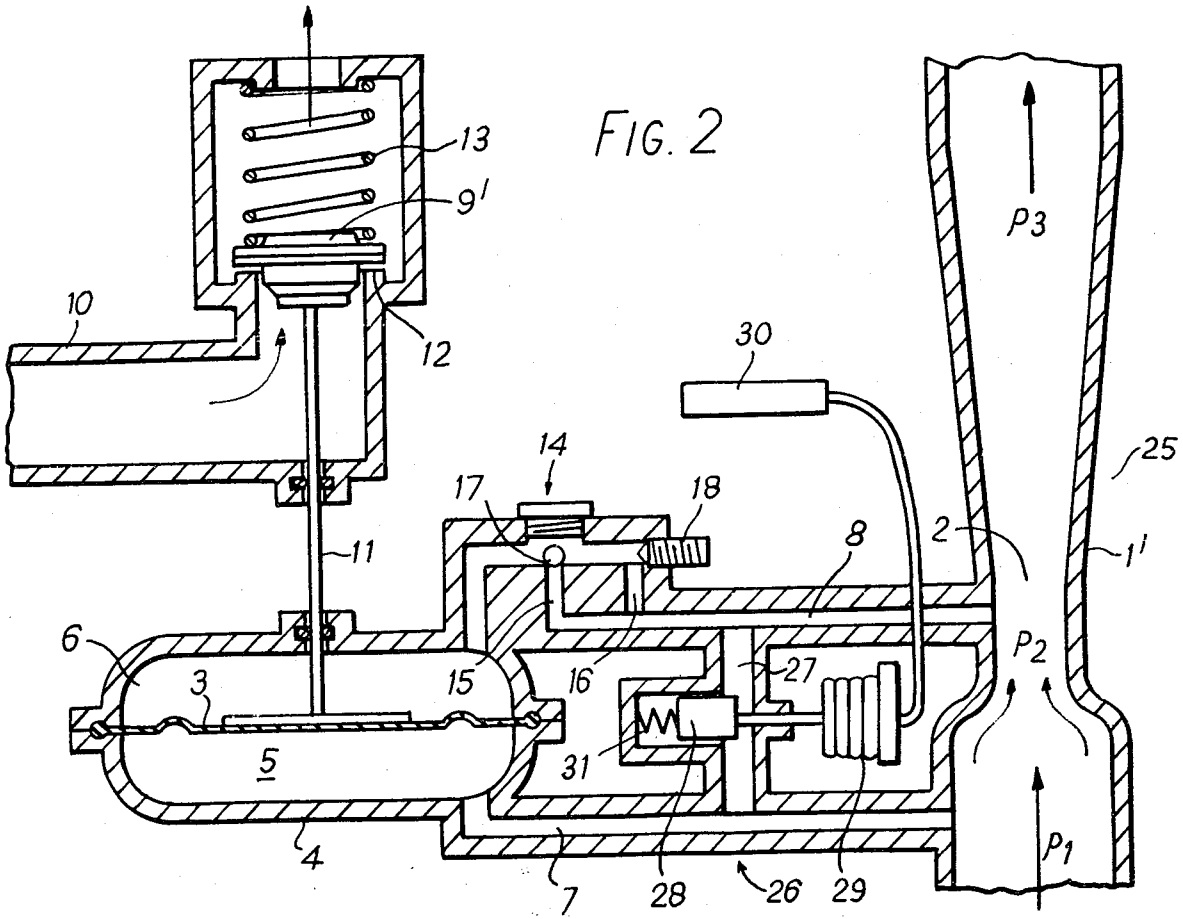
Figure 3:
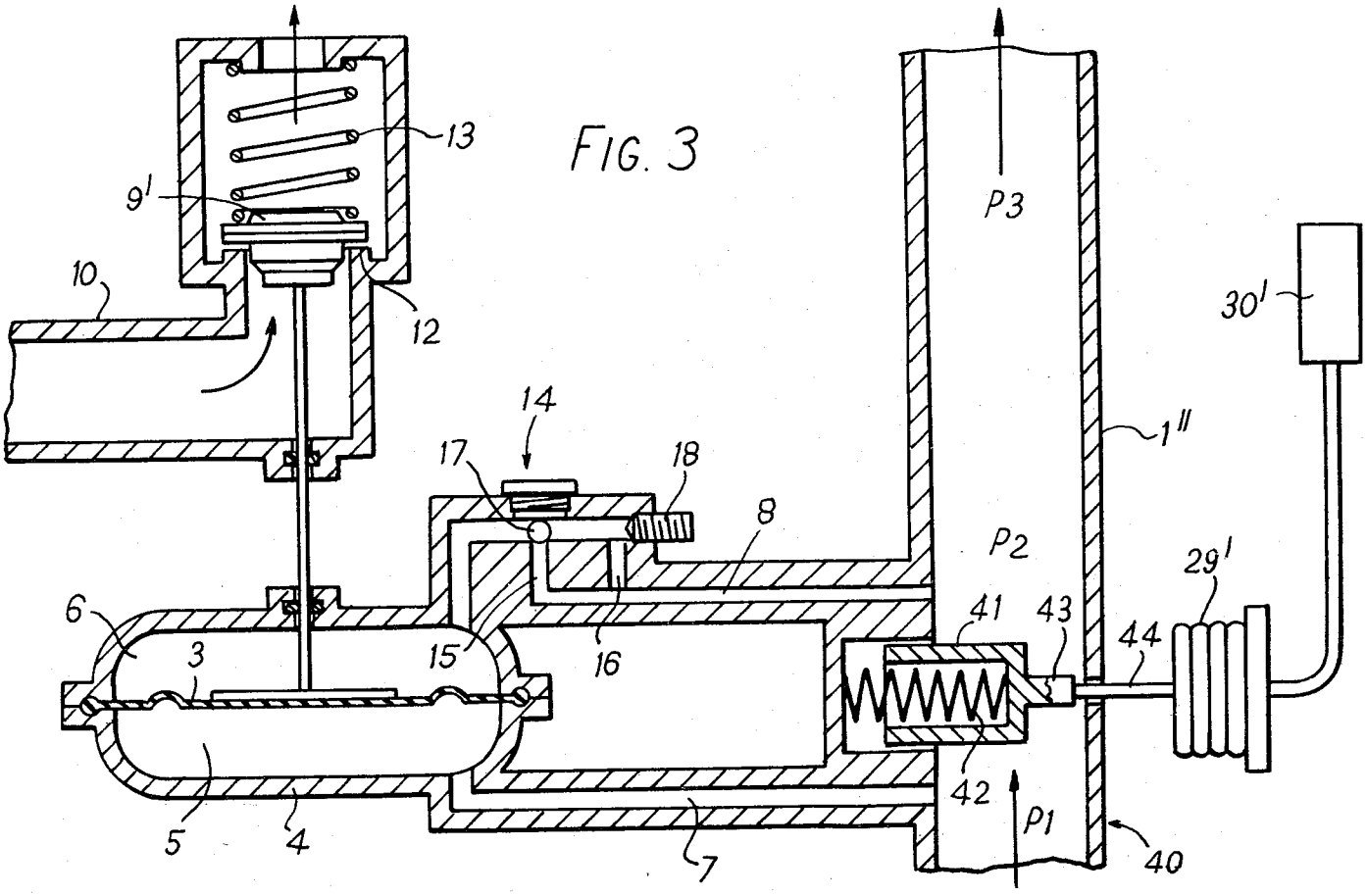

For a better understanding of the invention, and to show how the same may be carried into effect, reference will now be made by way of example, to the accompanying drawings in which:

FIG. 1 is a schematic cross-sectional view through a control valve system, in accordance with one example of the invention, for a gas-fired instantaneous water heater, FIG. 2 is a schematic cross-sectional view through a temperature-sensitive control valve system for such a heater and FIG. 3 is a schematic cross-sectional view through a second temperature-sensitive control valve system for such a heater.

Referring to FIG. 1, a water supply duct 1 is shaped internally to form a restriction constituted in this example by a venturi having a venturi throat 2. A flexible diaphragm 3 is arranged in a housing 4 separating the lower or high pressure part 5 of the housing from the upper or lower pressure part 6. The high pressure part 5 is in communication with the duct 1 upstream of the throat 2 via a passage 7 to sense a pressure P1 (which is a static or piezometric head). The low pressure part 6 is in communication with the duct 1 at the throat 2 via a passage 8 to sense a pressure P2 (which is also a static or piezometric head).

When there is not water flow P2 and P1 are equal and so there is no pressure difference across the diaphragm 3. When the water flows, however, P2 is less than P1 and so the diaphragm moves upwards. This movement of the diaphragm evacuates water from the low pressure part 6 of the housing 4.

The diaphragm 3 is connected to a gas supply valve 9 in a gas supply line 10 by an actuating rod 11. The valve 9 is urged into engagement with a valve seat 12 by a return spring 13 which opposes upward movement of the diaphragm.

Interposed between the low pressure part 6 of the housing 4 and the passage 8 is a so-called slow-ignition device 14. The device 14 comprises two parallel channels 15 and 16 each communicating between the low pressure part 6 and the passage 8. A ball valve 17 is placed at the mouth of the channel 15 to oppose the flow of water out of the low pressure part 6 into the channel 15, and an adjuster screw 18 restricts the flow of water out of the part 6 into the channel 16. This ensures that the gas valve 9 does not open suddenly. The device 14 does not substantially restrict the flow of water into part 6, as the ball valve 17 allows the water to flow from passage 8 to the part 6 via channel 15, and so the gas valve can close quickly once the flow of water in duct 1 ceases.

However, there is a rate of flow of water which will cause the gas valve 9 to open a very small amount indeed and no more. If the rate of flow of gas through this very small opening is so low that it may not be relied upon to ignite at the burner, then unburnt gas can collect inside the heater.

In accordance with this example of the invention the valve system is modified to give what is called herein, a 'snap' action in which the gas valve 9 does not open at all until the flow of water is able to absorb the heat release, and then opens far enough to pass an easily ignitable flow of gas without being able to dwell at a small opening insufficient to pass an ignitable gas flow.

The snap action is provided by a device 20. The device 20 compises a vertical passage 21 in communication with the low pressure passage 8 at the top and with the high pressure passage 7 at the bottom. The passage contains a ball 22, made, for example, of stainless steel or phosphor bronze, which does not fill the passage, having a diameter less than the width of the passage. A seat 23 is provided at the top of passage 21 for engaging with the ball 22 to stop the upward flow of water through the passage. Typically, using a stainless steel ball of diameter 11.11 mm., the internal bore diameter of the passage 21 is 11.80 mm., and that of the valve seat 23 is 2.50 mm.

In the example shown the vertical passage 21 communicates directly through the seat 23 with the passage 8 and directly with the passage 7. A post 24 is provided to prevent the ball blocking passage 7 and to retain the ball in the passage 21.

At a first predetermined difference between pressure P1 and P2, the flow of water through passage 21 causes the ball 22 to rise. When it reaches the seat 23 the flow ceases and causes the full differential pressure to be applied to the diaphragm. At or below this first predetermined difference, the valve 9 does not open at all because the pressure difference that does exist is partially destroyed due to the high pressure leaking into the low pressure, thus producing less differential across the diaphragm until the ball is on its seat.

Once the ball has lifted, the flow which lifted it stops, but the ball is held in place by the force equal to the differential pressure (P1−P2) multiplied by the area A of the passage through the valve seat 23. The relationship between this area, the weight of the ball and the differential pressure causes the ball to drop from its seat 23 when the flow of water through the duct 1, and hence the differential pressure P1−P2, is reduced to a specific value. In order to have a 'snap' action, it must be contrived that this occurs at a water flow rate through the duct 1 less than the rate which causes the ball to rise and hence low enough for the gas to snap off completely.

In other words, the ball will not rise to its seat until the flow rate through the duct 1 is sufficient to absorb the heat of the burnt gas and to produce a second predetermined pressure difference sufficient to permit a reliable flow of ignitable amounts of gas to the burner.

Until the ball is held against its seat, the difference between pressures in the passages 7 and 8 and thus also between the pressures P1 and P2 is maintained at or below the first predetermined level insufficient to open the valve 9 at all. In one practical example, just prior to the seating of ball 22 in seat 23, the differential pressure was about 62.4 millibars, which is insufficient to open the valve 9. Once the ball has seated, however, the differential pressure applied across the diaphragm 3 increased to about 117.0 millibars, which is sufficient to open the valve 9 to an extent which permits the reliable supply of ignitable amounts of gas to the burner.

FIG. 2 shows a temperature-sensitive control valve system 25 for a gas water heater. Parts of FIG. 2 corresponding to parts of FIG. 1 bear the same reference numerals as in FIG. 1 and will not be described again. The gas valve 9' of FIG. 2, unlike the valve 9 of FIG. 1, is a tapered plug which regulates the flow of gas dependent upon its opening. The operation of this valve is such that the gas rate is proportioned to the water rate in duct 1' so maintaining a constant temperature rise within the operating range of the heater.

The system of FIG. 2 as so far described is known. However, as shown, the operation of this proportioning valve is rendered responsive to a theremostat so as to give thermostatic control without a complex valve.

In accordance with the arrangement as shown, a thermostatic device 26 is provided. The device comprises a passage 27 communicating with the high and low pressure passages, 7 and 8 respectively. The device 26 further comprises a valve 28 operated by a bellows 29 which is connected to an ether filled bulb 30, which is mounted on the heat exchanger (not shown) of the heater to sense the water temperature.

The movement of the diaphragm 3 (and thus that of the gas valve 9') is dependent on the differential pressure P1−P2. The valve 28 modifies the differential pressure in dependence on the water temperature.

As the temperature of the heat exchanger sensed by the bulb 30 varies, the volume of the bellows 29 varies thus moving the valve 28 against, or with, the urging of a spring 31.

FIG. 3 shows another temperature-sensitive control valve system for a gas water heater. Part of FIG. 3 corresponding to parts of FIG. 1 or 2 bear the same reference numerals as in FIG. 1 or 2 and will not be described again.

In FIG. 3 the water supply duct is a straight sided duct 1''.

In accordance with the arrangement as shown, a thermostatically variable restriction 40 is placed in the duct 1''. The restriction comprises a cylindrical member 41 urged by a spring 42 to restrict the duct 1''. A stop 43 is provided to limit the restriction of the duct. A rod 44 connects the member 41 to a bellows 29' which in turn is connected to an ether filled bulb 30' arranged on the heat exchanger (not shown) to sense the water temperature.

The member 41 is moved by the bellows in dependence upon the sensed water temperature and modifies the pressure difference P2−P1 and this controls the amount of movement of the diaphragm and of the gas valve 9'.

In the arrangements shown on all three Figures, the passages 7 and 8 sense piezometric heads and the diaphragm, and hence the gas valve, is controlled in dependence upon the difference of these sensed heads as modified by the devices 20 (FIG. 1), 26 (FIG. 2) and 40 (FIG. 3).

It is possible to use the arrangement of FIG. 1 in conjunction with one or other of the arrangements shown in FIGS. 2 and 3 to produce a snap-acting thermostatic device. In the event that the arrangements of FIGS. 1 and 2 are used together, then passages 21 and 27 are each arranged to link passages 7 and 8. In the event that the arrangements of FIGS. 1 and 3 are used together, then passage 21 links passages 7 and 8.

The device 14 augments the thermostats in the sense that it can be adjusted to "damp out" the oscillations which sometimes are associated with the operation of gas thermostats. Thus use is made, for such "damping", of the valve which turns the gas on and off and, furthermore, advantage is taken of the valve's slow ignition device for this purpose.

What we claim is:

1. A control valve system for a gas-fired, instantaneous water heater, including a pressure sensor responsive to the rate at which water is conveyed by a ducting means to a heat exchanger incorporating a gas burner, a control valve, operated by said pressure sensor, for controlling the supply of gas to the burner, a connecting system coupling said pressure sensor to the ducting means and a control arrangement to inhibit said pressure sensor from sensing the water flow until the flow exceeds a rate sufficient to cause the pressure sensor to open said control valve to an extent sufficient to permit a reliable flow of ignitable amounts of gas to said burner, and wherein said connecting system includes first and second passages connecting said pressure sensor to points upstream and downstream respectively of a flow restriction formed in said ducting means, and wherein said control arrangement includes a further passage, linking said first and second passages, and containing a moveable element that is capable of closing said further passage.

2. A system according to claim 1 wherein said moveable element comprises a ball member and said further passage is formed with a seating to accommodate said ball member.

3. A system according to claim 2 wherein said further passage is formed with a stop member that prevents the ball member, when not seated in said seating, from blocking any of the passages.

* * * * *